US009494335B1

(12) United States Patent
Buchanan

(10) Patent No.: US 9,494,335 B1
(45) Date of Patent: Nov. 15, 2016

(54) BUILDING PRESSURE CONTROL

(71) Applicant: Pathian Incorporated, Fairfield Township, OH (US)

(72) Inventor: Daniel Buchanan, Fairfield Township, OH (US)

(73) Assignee: Pathian Incorporated, Fairfield Township, OH (US)

( * ) Notice: Subject to any disclaimer, the term of this patent is extended or adjusted under 35 U.S.C. 154(b) by 591 days.

(21) Appl. No.: 13/890,940

(22) Filed: May 9, 2013

(51) Int. Cl.
*G01F 25/00* (2006.01)
*F24F 11/02* (2006.01)
*F24F 7/08* (2006.01)

(52) U.S. Cl.
CPC ..... *F24F 11/022* (2013.01); *F24F 7/08* (2013.01)

(58) Field of Classification Search
CPC ..... G01F 25/00
USPC ..... 454/238
See application file for complete search history.

(56) References Cited

U.S. PATENT DOCUMENTS 4,508,021 A * 4/1985 Steinmann ..... 454/75
5,092,227 A * 3/1992 Ahmed et al. ..... 454/61
5,170,673 A * 12/1992 Ahmed et al. ..... 73/865.9
5,439,414 A * 8/1995 Jacob ..... 454/61
5,545,086 A * 8/1996 Sharp et al. ..... 454/238
5,705,734 A * 1/1998 Ahmed ..... 73/1.35
5,720,658 A * 2/1998 Belusa ..... 454/238
5,764,579 A * 6/1998 McMasters et al. ..... 700/2
6,763,731 B1 * 7/2004 Padden ..... G01F 3/16 73/861.57
7,726,186 B2 * 6/2010 Nair ..... 73/204.25
8,096,862 B1 * 1/2012 Demster ..... 454/237
2003/0157882 A1 * 8/2003 Boulanger et al. ..... 454/256
2007/0097636 A1 * 5/2007 Johnson et al. ..... 361/695

* cited by examiner

*Primary Examiner* — Steven B McAllister
*Assistant Examiner* — Samantha Miller
(74) *Attorney, Agent, or Firm* — Wood Herron & Evans LLP

(57) ABSTRACT

The air flow of an HVAC system for a multi-story building B is controlled by optimizing the pressure setpoint at the return air plenum PL-1 used for removing or recirculate air from the building, by measuring a pressure differential between the building B air and atmosphere A air at a sensor location P-2, computing a desired pressure differential between the building B air and atmosphere A air, based upon a computed stack effect pressure that is expected to develop at the sensor location on the building for the current inside and outside air temperature in the absence of mechanical action, and controlling the return air fan and damper D-1 to pressurize the air in at the sensor location to produce the desired pressure differential between the building B air and atmosphere A air at the sensor P-2 location.

9 Claims, 6 Drawing Sheets

Natural Occurring Neutral Planes and Pressures

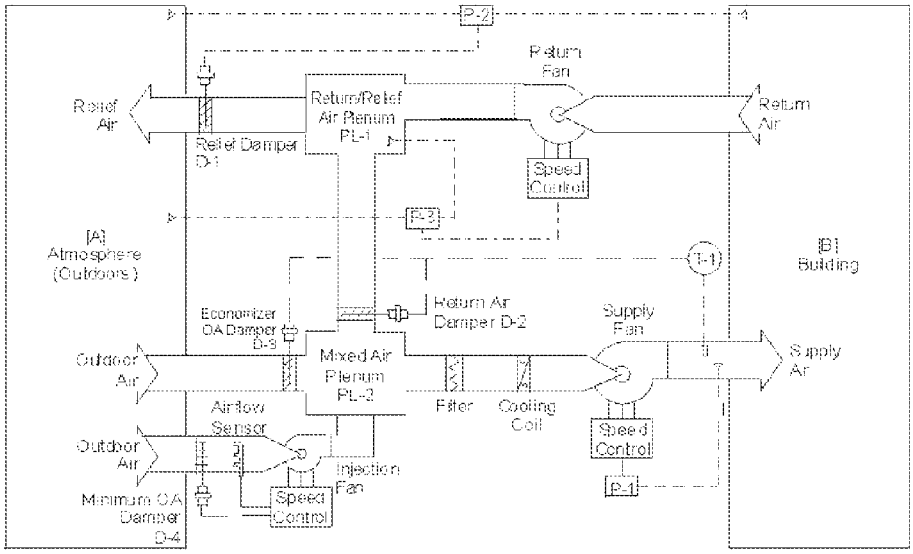
Figure 3 - Airside Economizer Configuration with Return Fan from ASHRAE Guideline 16-2003
PRIOR ART
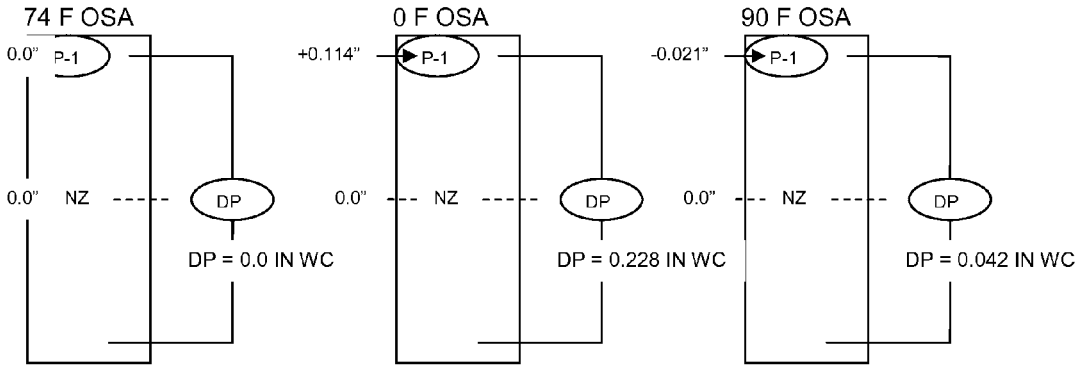
Figure 4

BUILDING PRESSURE CONTROL

FIELD OF THE INVENTION

The present invention relates to the control of heating, ventilation and air conditioning (HVAC) systems in multi-story buildings.

BACKGROUND OF THE INVENTION

HVAC systems come in a variety of types, each with specific characteristics and operational constraints. The components include air handlers and HVAC control systems. Air handlers input output and return fans, and may include Variable Frequency Drives (VFD's). The system may use exhaust, return, and outside air damper(s) which can be opened or closed or placed in intermediate positions in response to variable conditions. Control systems may include air differential pressure transmitters, minimum outside air flow transmitters and other devices to implement the air handler fan tracking control strategies. The control system itself may be a pneumatic control system such as were popular in the 1950's, or may be a fully modern Direct Digital Control (DDC) system using controllers and network devices to implement global control of the building's pressurization and air flow.

During peak heating seasons, many multi-story buildings have difficulty maintaining comfortable space temperatures in lower floors, such as building lobby areas. Studies of these problems have often determined that the primary cause of lobby temperature issues was directly related to the invasion of cold air on lower floors as a result of "stack effect" pressure differentials exerted on the building's envelop as outside air temperatures drop below 25 F. "Stack effect" forces are described, for example, in Canadian Building Digest, Article CBD-104, "Stack Effect in Buildings" (incorporated by reference herein) and the University of Hong Kong Lecture entitled "Air Movement and Natural Ventilation". The former details how stack effect forces are created and calculated, and the latter discusses how stack effect forces affect a building's envelop air infiltration rates and presents calculations to predict air movement.

All multi-story buildings above four stories experience building pressurization as a function of the difference between inside and outside air temperature and the resulting difference between inside and outside air density. These problems become the most extreme during the coldest winter days where the inside and outside temperatures are most divergent—building pressurization problems start becoming noticeable as outdoor air temperatures fall below 25 F. At this temperature range, "stack effect" forces created by different air densities of the outside and inside air become disruptive of the HVAC control system strategy used to control air handler fan tracking and building pressurization control.

The pressurization of a building depends on many factors including the building's height and architectural and mechanical system designs. In many cases, the most significant issue is control of HVAC mechanical systems fans, outdoor air intake and exhaust systems. Traditionally speaking, standard HVAC controls sequence strategies fail when the structure starts to encounter significant stack effect forces because the dynamics of how air is returned back to the mechanical systems changes as stack effect forces increase.

FIG. 1 illustrates building pressurization. Each box represents a single story building 100 feet tall which maintains an inside temperature of 74 degrees. For the simplicity of modeling, each building will be modeled as having no compartments or floors to stop natural air flow inside and outside the building, and relatively equal air permeability on all floors. Furthermore, for modeling, the average pressure of the air taken over all of the walls inside the building will be assumed to be equal to the average pressure of the air taken over all of the walls outside of the building, as is the normal equilibrium condition for buildings. In such a structure, basically a very tall box with no openings, there is a "neutral plane" where the pressure inside the structure is exactly equal to the pressure outside the structure. Under the conditions described above, the neutral plane occurs exactly in the vertical middle of the building. In this idealized example, the outside air temperature does not affect the position of the "neutral plane", however, in the real world, the neutral plane of the building could be higher or lower depending on all the other forces that may affect the pressure in the building including the fans and dampers of the HVAC system.

If the air temperature inside and outside of the building is the same, then the pressure inside and outside of the building will be the same at all heights. However, if there is a difference in temperature between the inside and inside and outside of the structure (as will typically be the case when the building is climate controlled), then there will be a difference in air density between inside and outside air and, as a result, a difference in air pressure at positions spaced vertically from the neutral plane. The average pressure inside and outside the building will remain equal, and the "neutral plane" will remain at exactly half the height of the building, however, when the air inside is less dense (when the outside air is colder) then when one moves away from the "neutral plane", pressure changes more outside than inside, and when the air inside is more dense (when the inside air is colder) then when one moves away from the "neutral plane", pressure changes more inside than outside.

As elaborated in the above-referenced papers, the difference in pressure a given vertical distance from the "neutral plane" can be expressed as $$p_c = 7.6\ h\left(\frac{1}{t_c + 460} - \frac{1}{t_i + 460}\right)$$

where $p_c$ is the theoretical pressure difference due to stack effect in inches of water column, h is the distance from the neutral plane height in feet, and $t_c$ and $t_i$ are outside and inside temperatures in ° F.

For example purposes, consider the seven story building of 100 ft in height (14.28 ft per story), illustrated in FIG. 1. Inside-outside pressure difference due to "stack effect" is shown in FIG. 2. As shown in FIG. 2, when the outside air (OSA) is at 74 degrees, the same as the inside air, there is no differential pressure from inside to outside at any height. However, a substantial differential pressure (lower pressure inside at the bottom, higher pressure inside at the top) occurs at 0 degrees outside temperature, and a reverse differential pressure (lower pressure inside at the top, higher pressure inside at the bottom) sets up at 90 degrees outside temperature.

FIG. 2 illustrates that the stack effect differential pressure in the winter is over 5.4 times greater that of the summer, and opposite in direction, for the reason that the indoor-outdoor temperature difference is far greater in the winter. Further note that in the summer, the upper floors of the building are under a negative pressure while the lower floors are under a positive pressure. The opposite is true in the winter, the upper floors of the building are positive and the lower floors are negative, although the wintertime pressure difference has over five times greater magnitude than the summer pressure difference on the same floor.

The difference in pressure across a building's envelop seems insignificant at first glance, but the actual air flows that can be caused by stack effect are considerable. To demonstrate, consider a fully open lobby entryway door on the first floor of a seven story building when the outside air temperature is 0 F. From FIG. 2, we see that in this condition, all other factors being equal, the lobby's pressure is −0.114 IN WC relative to outdoor conditions. We can estimate the flow through the entry way by the equation:

$$Q=2400A\sqrt{h}$$

where Q is the air flow in cubic feet per minute, A the area in square feet and h the pressure difference in inches of water. Applying this equation to our lobby entry way at 0 F we find that a 6'8"×3' door can move 16,206 CFM at 0.114 pressure difference across the entryway. A draft of this magnitude can overwhelm mechanical systems attempting to maintain a comfortable temperature in the lobby area, causing temperatures in the lobby to drop to unacceptably low levels in the winter, as has been frequently observed in multi-story structures.

FIG. 3 is a schematic drawing of a standard HVAC system that controls air flow. In this system, a supply fan provides supply air to the building. Supply air is typically a temperature controlled mixture of outdoor air and recycled air returned from the building, which are mixed in the mixed air plenum PL-2. The amount of outdoor air that is recirculated is a function of outdoor temperature. Typically, outdoor air is used extensively when the outdoor temperature is between about 45 and 78 degrees F. At these temperatures, the HVAC system enters a so-called Economizer mode, in which an Encomizer OA Damper D-3 is opened to permit outdoor air to enter the mixed air plenum PL-2, and the return air damper D-2 is closed to cut off the flow of return air. Outside of the Economizer mode temperature range, Economizer mode is disabled, and the economizer OA damper D-3 is closed and return air damper D-2 is opened, so that return air flows to the supply fan. Outdoor air is used sparingly at these temperatures, for the reason that the outside air is more costly to temperature control than return air from the building. However, even in extreme temperatures below 45 or above 78 degrees F., a certain amount of outside air must be drawn into the system to meet air freshness standards, which depending on occupancy and other factors can require that at least 15 to 30 percent of the air supplied to the building is fresh air. Accordingly, at such temperatures, the minimum required outdoor air is supplied to the mixed air plenum PL-2 via an injection fan which is speed controlled by an airflow sensor. A minimum outside air damper D-4 is opened in this condition.

The supply fan is typically speed controlled to provide a supply air pressure sufficient to drive air into the building. The pressure of supply air is typically detected by a pressure transmitter P-1 positioned at the supply fan outlet.

Because outside air is routinely supplied to the building, to maintain an equilibrium pressure within the building, the HVAC system must exhaust a certain amount of return air outdoors. Generally, the amount of air vented to the outdoors must be equal to the amount of outdoor air being pulled into the mixed air plenum PL-22 and subsequently delivered to the building via the supply fan. The HVAC system provides this relief air path via a return/relief air plenum PL-1, which receives return air from the building, and is connected on the one hand to the mixed air plenum PL-2 for delivery of return air to the supply fan, and connected on the other hand to a relief air path leading outdoors. The air flow through the relief air path is controlled by a relief damper D-1. The return air path typically also includes a return fan which has the purpose of drawing air from the building and elevating the pressure of the air supplied to the return/relief plenum PL-1 to ensure that the air will be exhausted outdoors when the relief damper D-1 is opened.

The control applied to the return fan and relief damper D-1 typically uses two differential pressure transmitters that reference atmospheric conditions to control the air handler's return air fan speed. Pressure transducer P3 senses the relative pressure between Plenum PL-1 and the outdoor air, and controls the return fan speed to provide a slightly elevated pressure in the Air Plenum PL-1, so that air will flow out the relief air path when relief air damper D-1 is opened. Pressure transducer P-2 senses the relative pressure between the building and outdoor air, and is used to control the relief air damper. Typically, when elevated building pressure is detected by transducer P-2, indicating that more outdoor air is being supplied through the supply fan than is being exhausted via the relief air path, then damper D-1 is opened to increase the exhaust air volume. In many cases there are several relief air paths each having an independent pressure transducer and independently controlled damper.

This control algorithm, while in common use, suffers from a number of inefficiencies which have been identified by the inventor, and it is an object of the invention to improve upon these existing control methods by application of principles of the present invention.

SUMMARY OF THE INVENTION

The inventor has shown that the performance of control strategies for multi story facilities can be dramatically improved by adaptation of those strategies to account for stack effect pressurization.

In the system illustrated in FIG. 3, according to the known control strategy discussed above, the speed control for the return fan is typically programmed to maintain a slight positive pressure in the building relative to outside air at all times, such as 0.05 IN WC. This is accomplished by modulating the air handler's relief damper D-1 open (or shut) as the building pressure deviates from setpoint. If the relief damper D-1 modulates open, the return air discharge pressure decreases and is sensed by the second transmitter P-3 of the control system. This causes the RAF to speed up because the control system is programmed to maintain a constant return fan discharge pressure across transducer P-3 at all times; setpoints vary based on designer preferences but typically range between 0.1 and 0.25 IN WC.

The major flaw in this control sequence is that it assumes the building is under a relative constant pressure differential vs. outside air, which is often not the case. In fact, often a building has a substantial temperature and height dependent variation between internal pressure and external pressure. Traditional control strategies have no mechanism to account for these variable pressures which are applied to the pressure transducer P-2 and P-3 as a function of temperature and transducer height. Indeed, the inventor has shown that an air handler placed on the seventh floor of a building, that references building and outdoor pressure with differential pressure transmitter P-1, reads pressure differentials that are affected as much by outdoor temperature as by the speed of the return fan.

In accordance with the control algorithms disclosed herein, the setpoint for the return fan, when compensated for stack effect, is reduced to between 0 and 0.1 IN WC. This setpoint change results in a significant reduction in brake horsepower consumed by the air handler return air fan at all operating loads. Furthermore, the reduction in return air fan pressure reduces the likelihood of wasteful scenarios, such as can occur when air flow is forced through the supply air fan by the high relative pressure, causing the supply air fan to slow or stop, with the inefficient net result that supply air flow is generated from the return air fan driving air through the supply fan, which is far less efficient than using the supply air fan itself to provide supply air flow.

The control of the setpoint for return air involves accurate computation of stack effects. FIG. 4 illustrates that, if all mechanical ventilation systems were off and no other forces were acting on the building's envelop other than stack effect pressures, a pressure transmitter P-1 on the seventh floor would read 0.0 IN WC when OSA temperature is 74 F. When the OSA temperature is 0 F, the same transmitter would read a positive 0.114 IN WC. If the OSA temperature is 90 F, the transmitter would sense a negative 0.021 IN WC.

In order for a pressure controlled fan tracking system to function properly, it must have an attainable setpoint. The stack effect generated pressures shown in FIG. 4 are easily able to overwhelm the limits of the mechanical system. On cold days, for example, the substantial positive building pressure can cause the relief damper D-1 to operate wide open (as a result of the differential pressure on sensor P2) while the air handler's return air fan runs incessantly at full speed. The inventor has in fact seen that in low ambient air conditions, taller buildings act like natural chimneys and supply the upper floors of the building with a continuous column of warmed air rising up from the lower floors, which is then wastefully blown outside. The rate of air flow traveling up the building is proportional to how much air can escape the structure and the building's ability to replace that air via natural infiltration below the neutral plane or forced ventilation entering the building at any level.

For an example, refer to FIG. 4; at OSA temperatures of 0 F, the air handler in our example would see 0.114 IN WC (over twice the typical setpoint) and open its relief damper toward the fully open position. In reaction to this, the return air fan would drive toward a speed of 100% to relieve as much air as possible from the building. The air handler on the seventh floor is in effect seeking to exhaust not only its floor design exhaust CFM but also rising CFM caused by stack effect in the building, in a often vain attempt to establish the pressure differential setpoint in which the inside and outside air are at near equal pressure. This enhances the "induced draft chimney" and tends to maximize the amount of air infiltration into the building on the lower floors below the neutral plane: the air the handler removes is quickly replaced by rising air infiltrated in the lower floors, and the faster air is removed from the upper floors, the faster air infiltrates into the lower floors of the building. This not only increases energy cost substantially but can overwhelm the ability of the lower floor HVAC mechanical systems to condition the spaces once their design loads are exceeded from the cold OSA infiltrating the building.

To properly manage the return air fan, the pressure differential setpoint controlling the fan must be adjusted by an offset which represents the stack effect pressure that would appear at the height of the sensor at the current outdoor air temperature, so that the return air fan does not attempt to drive the building to a static differential pressure relative to OSA, but rather seeks to maintain the building at an appropriate differential pressure relative to OSA for the current outside air temperature when considering stack effect.

Thus, in accordance with principles of the present invention, to control building pressure, a control sequence references the difference between the building and outdoor pressures and modulates the air handler's relief air damper in response to measured pressure differential as adjusted for the calculated effect of stack effect pressure differentials at or near the current outside air temperature.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

FIG. 3 is a schematic drawing of a standard HVAC control system;

FIG. 4 is an example of the behavior of a conventional pressure controlled fan tracking system in cases of low outside air temperature;

DETAILED DESCRIPTION OF THE INVENTION

The inventor has shown that as the outside air temperature drops below 25 F, a relatively tall building's stack effect forces begin to overwhelm the ability of a conventional control sequence to maintain targeted building pressures, as pressure gradients resulting from stack effect cause large quantities of air migrate to the upper floors of the building. The increased pressure in the building's upper floors causes the upper floor air handlers to open the air handler relief air dampers to relieve that building pressure, tending to increase the air flows upward through the building and infiltration in the lower part of the building. The faster migrating air is exhausted from the lower part of the building to the upper part of the building, the faster the air rises in the building and the faster upper floor air handlers exhaust it. As a result, the building is turned into an induced draft chimney with unnecessary heat energy as well as mechanical energy ultimately being expended to heat the building.

The inventor has further shown that when stack effect forces become significant, control strategies that are based upon CFM measurement may lose control of the air handler's return air flow speed, and cause the fans to operate at minimum speeds. This happens when the SAF draws sufficient airflow across the return air flow station to cause the control system proportional-integral-derivative (PID) loop to back down the RAF to a minimum value. This can cause the air handler unit to trip-out on low static pressure safety or the RAF's motors to overheat if the minimum speed settings are too low.

The inventor has also observed that stack effect force becomes much more complex as buildings of dissimilar height are connected together via common passageways. These passageways create large pressure equalization paths within connected buildings and can become wind tunnels as outside air temperatures drop and stack effect forces increase on the structures.

Figure 1:
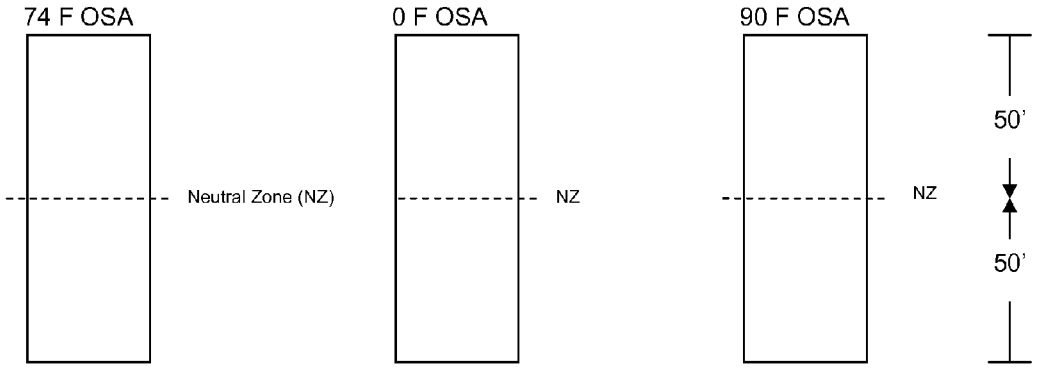
Figure 1 PRIOR ART
FIG. 1 is an illustration of building pressurization and the neutral plane of a building at various temperatures.
Figure 2:
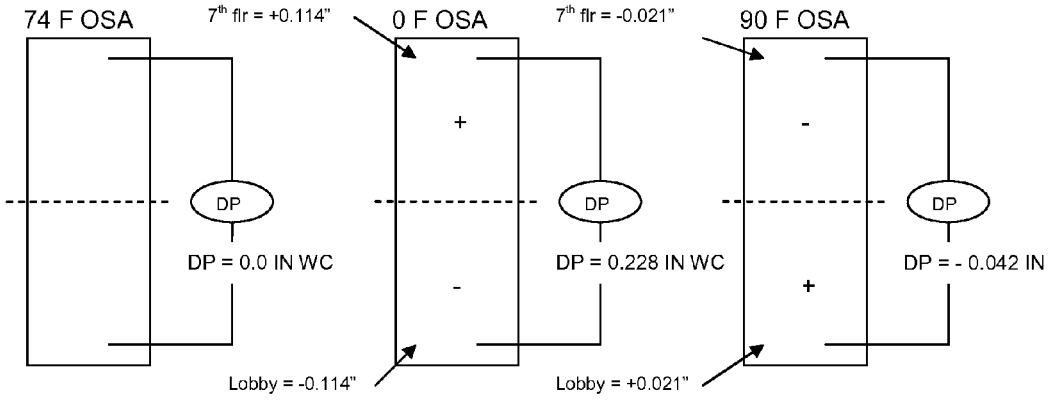
Figure 2 PRIOR ART
FIG. 2 illustrates the stack effect forces accumulated in the building shown in FIG. 1 at various temperatures.
Figure 5:
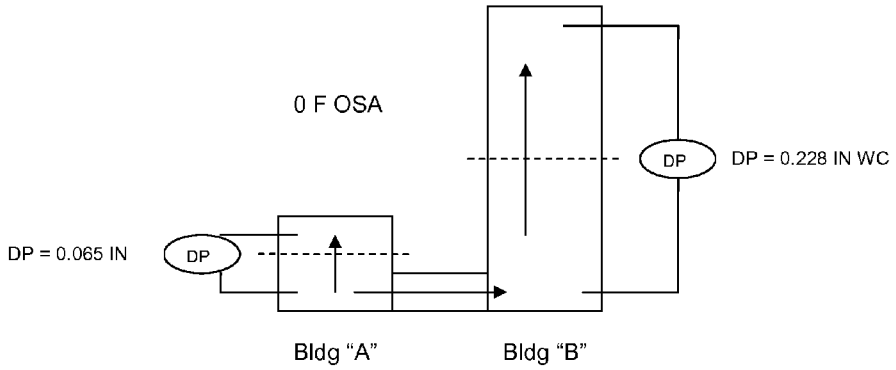
FIG. 5 is an illustration of stack effect forces operating in a complex of buildings of dissimilar height connected via common passageways.

Elaborating on this last effect, referring to FIG. 5, consider two dissimilar height structures where two story building "A" and seven story building "B" are connected together by a common hallway on the lower floor of the two story building "A".

As in previous examples, the stack effect pressure gradient on the FIG. 5 seven story building "B" at 0 F is 0.228 IN WC but the stack effect pressure gradient exerted on building "A" at the same OSA temperature is only 0.065 IN WC. In other words, building "B" sees 3.5 times the stack effect pressure differential as is seen in building "A". Under these conditions, the lobby pressure of building "A", as referenced to OSA pressure, is −0.0325 IN WC but the taller building's "B" lobby is under a −0.114 IN WC. This creates a pressure differential of 0.082 IN WC. If only one fourth of this differential (0.020 IN WC) appears across a 10'×8' hallway joining the buildings, that hallway can transfer 45,311 CFM between the two buildings.

In a practical example, the air transfer in the hallway between the two buildings in the FIG. 5 example would depend on the lower building's envelop air infiltration rate and the taller building's ability to exhaust the lower building's envelop air infiltration. In the lower building, a relative constant rate of air would infiltrate the building via all exterior cracks and crevices in the building envelop and intermittent large quantities of air would infiltrate the building as people entered and exited from the lobby of the lower building. The intermittent air influx to the structure would be proportional to the opening size of the entryway and its construction, vestibule entry ways exhibiting less air influx and single entry doorways exhibiting more substantial air influx. If the taller building cannot provide a path for the lower building's air to exit, no air would be transferred down the hallway in our example. Instead, if no air could exit the taller structures, the two structures would equalize lobby pressures and the top floor of the taller building would pressurize. In this case, excluding other consequential forces acting on the building such as mechanical systems and wind related forces, the taller structures upper floor pressure would equal:

Upper Floor Pressure=lobby *DP*+the taller buildings stack effect pressure=−0.0325 IN *WC*+0.228 IN *WC*=0.01995 IN *WC*

Substantial forces are created by the above-calculated pressure. Although the theoretical position of a building's neutral plane is located mid-position of the building's height, the actual position where the "buildings inside pressure"=the "OSA pressure" rarely resides at this position. This is because the summation of all air flows and pressure generating forces acting on the building envelop will determine the actual position of a building's neutral plane.

Pressure generating forces can be categorized as either "naturally occurring" or "mechanically induced". Naturally occurring forces include wind and stack effect forces being exerted on a building's envelop and the differential pressures created by them. Generally, naturally occurring forces are all forces exerted on the structure when all mechanical ventilation systems are turned off. Mechanically induced forces include the forces of air handlers and control systems that operate them.

Figure 6:
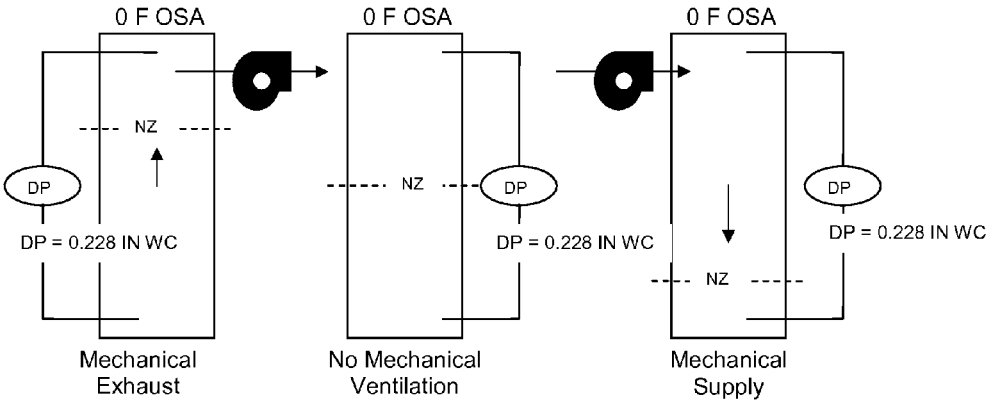
FIG. 6 is an illustration of the change in the neutral plane of a building as a function of whether air is being exhausted or supplied to upper floors.

To illustrate this point, FIG. 6 shows the same 100 foot tall single story building shown in previous Figures, this time including an exhaust fan to the top of building on the left, a supply fan to the top of the building on the right and no mechanical ventilation to the center building. In this example, the OSA temperature is 0 F. Notice the "stack effect" pressure differential from the top to bottom of each building remains the same, but the building's "neutral plane" position, i.e., the position where the inside air pressure equals the outside air pressure, is determined by whether air is being exhausted from or supplied to the building by mechanical system fans. The mechanically driven exhaust of air from the building on the left raises the neutral plane position and the mechanically driven supply of air to the building on the right lowers the neutral plane position.

A key observation from FIG. 6 is that mechanical energy is needed to change the natural position of a structure's neutral plane, but it will not affect the actual differential pressure caused by the "stack effect" between the upper and lower floors of the building. That is, mechanical energy moves the natural position of the neutral plane in a building, all other things being equal.

Figure 7:
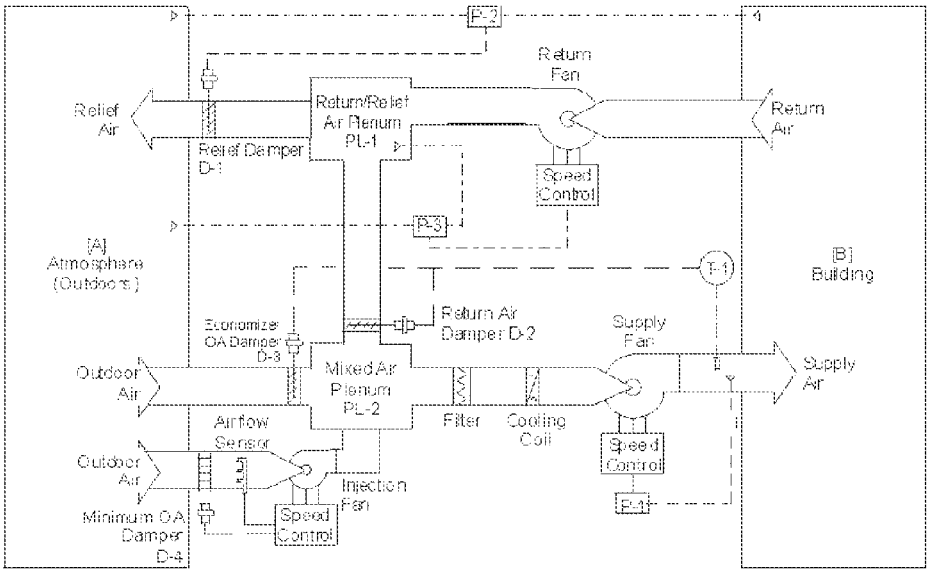
FIG. 7 is an illustration of a pressure control strategy in accordance with principles of the present invention.

Principles of the present invention provide a new HVAC control strategy called "Pathian Optimal Building Pressurization Control" or POBPC. The POBPC fan tracking algorithm requires the exact same peripheral devices, as illustrated in FIG. 7, as the previously mentioned "pressure controlled" fan tracking algorithm. However, the use of those devices is substantially different.

POBPC differs from standard HVAC building pressurization control strategies because it takes into consideration the desired position of a structures "neutral plane" pressure, and then develops a "dynamic" building differential pressure setpoint relative to OSA pressure, to control the return air fan and damper D-1. As stack effect pressure differential increase on a structure, the POBPC control algorithm proportionately adjusts the pressure differential setpoint, which positions air handler relief air dampers and return fan speeds to optimally manage building pressure in all weather conditions.

The POBPC control algorithm calculates a "dynamic" building pressure setpoint by first calculating the stack effect forces being exerted at the differential pressure sensors P2 and P3, which are normally positioned above the "neutral plane" of a building. To do this, POBPC uses the aforementioned "neutral plane" calculation:

$$p_c = 7.6\ h\left(\frac{1}{t_c + 460} - \frac{1}{t_i + 460}\right)$$

Where pc is the theoretical pressure difference due to stack effect in inches of water column, h is the distance in feet from the neutral plane to the height where the buildings differential pressure is measured, and tc and ti are outside and inside temperatures in ° F.

The "h" factor in the above equation allows calculation of a building static pressure differential setpoint to position the "neutral plane" in the building at any level desired, as long as the height of the building's differential pressure transmitter is known. Specifically, substitute for "h" the distance from the transmitter we want the building's neutral plane to reside, and the air handler will attempt to drive the neutral plane to that position.

For example, consider a 100 ft tall seven story building, equipped with a single air handler that has a static pressure differential transmitter installed on the 6th floor at 85 ft in height from ground level, with an inside air temperature of 74 F, an OSA temperature of 0 F. Assume the goal is to drive the neutral plane down to the first floor, for the purpose of reducing air infiltration in the building lobby and particularly reducing inrush of cold air upon entry and exit of patrons. In this case, equation would become $$Pc=7.6(85)(1/(0+460)-1/(74+460))=0.195\text{IN}$$
$$WC=\text{"POBPC Setpoint Offset"}$$

This setpoint, used as the control point for the return fan on the $6^{th}$ floor, would cause pressurization of the building such that the lobby pressure is neutral to OSA pressure at the lobby height, thus substantially diminishing air infiltration entering the building's envelop at that height. Without applying the 0.195 offset to the setpoint, the lobby static pressure as reference to OSA conditions would be as low as −0.145 IN WC (it may not go this low if the return fan lacks the mechanical power to exhaust the amount of air that will infiltrate the lobby at such a negative pressure). At that negative pressure, the potential airflow entering our lobby is substantial. Using the equation:

$$Q=2400A\sqrt{h}$$

where Q is the air flow in cubic feet per minute, A is the area in square feet and h the pressure difference in inches of water. Applying this equation to our lobby entry way at 0 F we find that a standard doorway opening (6'8"×3') can move 18,260 CFM at 0.145 pressure difference across the entryway. Again, a draft of this magnitude can overwhelm mechanical systems with added and unaccounted for load, causing temperatures in the lobby to drop to unacceptable levels, an effect that has often been experienced in taller buildings during cold winter days.

As elaborated, the present invention provides an optimal pressure control strategy permitting better control over uncontrolled outside air infiltration. Specifically, the invention provides a new concept in HVAC control strategies to control building pressurization by applying a pressurization offset to the return air fan. This provides a number of advantages:

1. Optimizes air handler return air fan speeds under all OSA conditions.
2. Minimizes building envelop differential pressures as referenced to OSA pressure conditions and diminishes undesirable OSA infiltration loading.
3. Manages building pressure to prevent over exhausting of air handler ventilation systems.
4. Eliminates airflow monitoring stations used for air handler return air fan tracking algorithms.
5. Allows for Energy Management System alarming if the building is being under or over pressurized by the HVAC mechanical systems at any floor level and regardless of the stack effect forces being exerted on the building.
6. Manages air flow migration between two dissimilar height structures over the entire design OSA temperature load.

The inventor has demonstrated a further drawback with conventional control strategies which has been addressed according to principles of the present invention. Specifically, further advantages may be obtained by centralizing the control of return air handlers and relief air dampers. Specifically, in accordance with this aspect of the invention, all return air fans and relief dampers are controlled with reference to a combined "POBPC setpoint". All of a building's air handlers fan tracking and building pressurization mechanical systems are controlled as a single unit based on this setpoint. The "POBPC setpoint" may be chosen to be equal to the pressure exerted on the building when all mechanical systems are turned-off, which minimizes the use of mechanical energy, or it may be choosen to place the neutral plane at any desired height in the building.

The goal of an POBPC strategy is to minimize the building envelop static differential pressure at all times and under all weather conditions. This minimizes the air infiltration/exfiltration rates and lowers energy cost. During moderate temperature days, the POBPC algorithm would control the building's neutral plane in the exact center of the building's height. This theoretically maintains the building's highest and lowest points at equal but opposite building static differential pressures. By keeping these pressures as small as possible, we can minimize the amount of air leakages entering and leaving the building around window openings and other cracks and crevices in the buildings envelop.

The POBPC algorithm first calculates POBPC setpoint and then sets a global parameter that can be referenced by all other air handlers in the building. Once the setpoint is calculated, the control system sends a global output to all building air handlers to modulate the air handler's relief dampers to maintain the buildings static differential setpoint. As the building's air handlers modulate their respective relief dampers, the units return air fans speeds are automatically adjust to maintain a static pressure setpoint of between 0 and 0.1 IN WC above outside air pressure in the return fan discharge plenum. This setpoint is varied to optimally control the return air fan speed of the air handler. By varying this setpoint, the air handler's return air fan speed is controlled toward an optimal speed that supplies the proper amount of relief and return air to the air handler. The theoretical optimal setpoint occurs when the relief damper(s) are 1005 open and the return air fan(s) is(are) moving at the lowest speed possible to maintain the building pressure setpoint, thus minimizing the mechanical energy expended. In typical applications, the relief dampers are controlled to slightly less than full open positions when air is being relieved from the facility via the air handler.

This is an improved control sequence compared to the "pressure controlled" fan tracking algorithm previously described, in that it utilizes an adjusted building static pressure transmitter signal as an input parameter, and uses a much smaller return air plenum pressure setpoint than is typically used.

The POBPC setpoint is calculated to place the building's neutral plane at an optimal location in reference to OSA/inside air temperatures and the distance of that set point from each respective buildings differential pressure sensing transmitter. In other words, the POBPC method can attempt to position the building's "neutral plane" at any building height as long the distance of that desired location from each pressure sensing transmitter is known.

Figure 8:
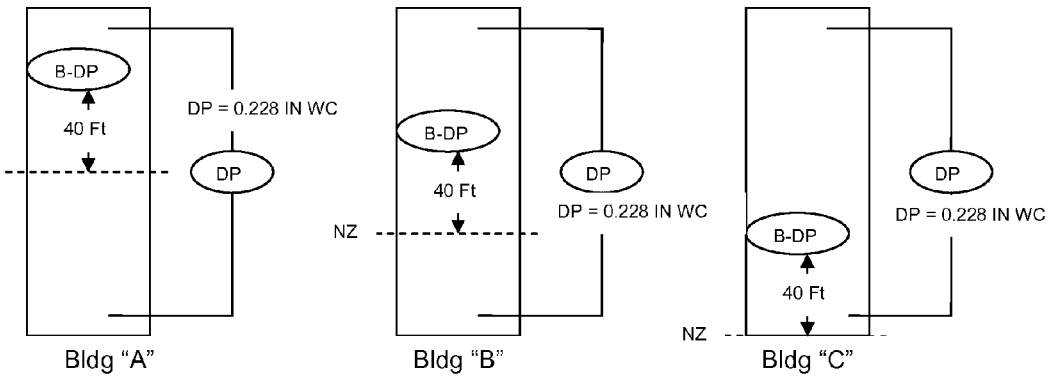
FIG. 8 is an illustration of three 100 foot tall buildings each of which has a differential pressure sensor at a different height.

This is illustrated in the example of FIG. 8, which shows three 100 foot tall buildings which have building static pressure transmitters in three different locations.

In our example, the "POBPC setpoint" is −40 feet. In other words, it is desired to set the differential pressure between the building and OSA to zero at a point 40 feet below the transmitter. Notably, the overall building differential pressure from the bottom to top of the building does not change as the neutral plane moves in the building, only the relative pressure at each height compared to the outside air at each height of the building. Because the POBPC algorithm positions the building's "neutral plane" at any desired height, building pressurization can be managed in all weather conditions in a more precise manner.

Figure 9:
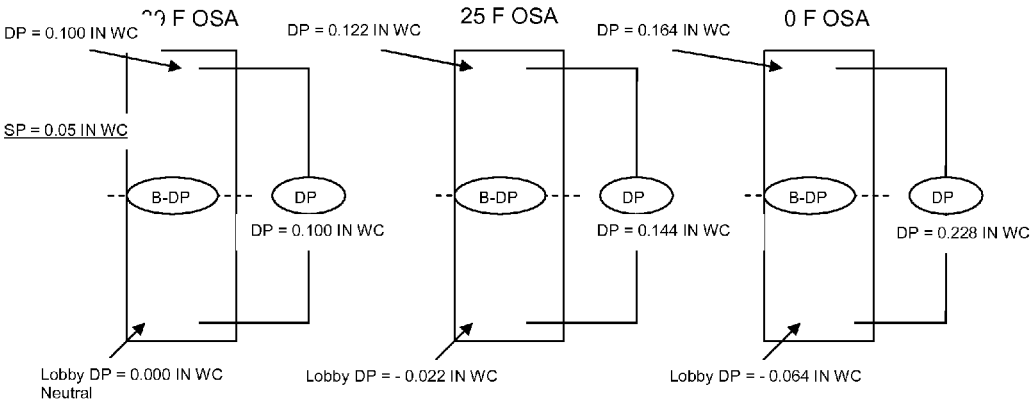
FIG. 9 is an illustration of the change in lobby pressure of a 100 foot tall building at different outside air temperatures.

Consider now the example of FIG. 9; it again is a 100 foot tall seven story building. The building's pressure differential transmitter is at the exact center of the building height. Theoretically, controlling all building mechanical systems based on a transmitter at this location will allow the magnitude of the differential pressure relative to atmosphere at the top of the building to equal the differential pressure relative to atmosphere at the bottom of the building, but opposite in sign. In this example, the building's air handling units reference this transmitter to control building pressure. If the vertical center of the building was maintained at 0.05 IN WC (a typical building pressure setpoint for return air), the lobby pressure would be driven to a substantial negative value as the OSA temperature drops, as seen in FIG. 9. Specifically, the 100 foot tall seven story building lobby will become pressure negative as OSA temperature falls below 39 F, and the lobby is three times as negative at 0 F OSA temperatures as it is at 25 F OSA temperatures. If this building was a 200 foot tall 14 story building, the lobby would become negative at 56 F and would develop a −0.408 IN WC lobby pressure at OSA temperature of 0 F. These substantial negative pressures generate substantial air infiltration even when doors are generally well controlled, and account for the difficulties in lobby temperature maintenance in such buildings on very cold days.

An "Optimal Building Pressure" (POBPC) approach allows a building's mechanical systems to operate as a single unit directed at the goal of neutralizing air pressure at a desired level. This control sequence opens all air handler relief dampers using one building pressure control variable, referenced by all air handler air control loops to maintain an "POBPC setpoint" at any location in the building's height. This is important because it insures the system relieves only the air required to maintain circulation, while maintaining the building's pressurization at the desired level. Because return air fans are indirectly controlled by the relief damper position, they too operate at the minimal speed required to relieve the correct amount of air from the building.

Figure 11:
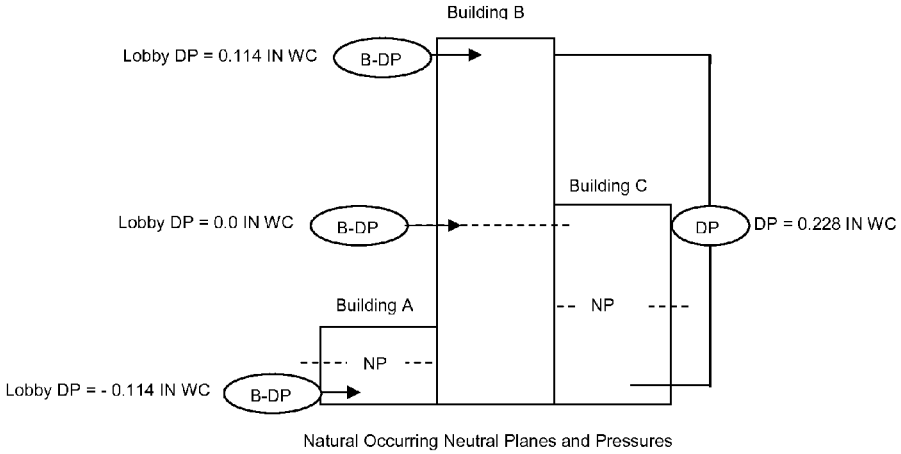
FIG. 11 is an illustration of a building complex having three buildings, each with a pressure tranducer at a different height and experiencing different stack effect neutral planes.
Figure 12:
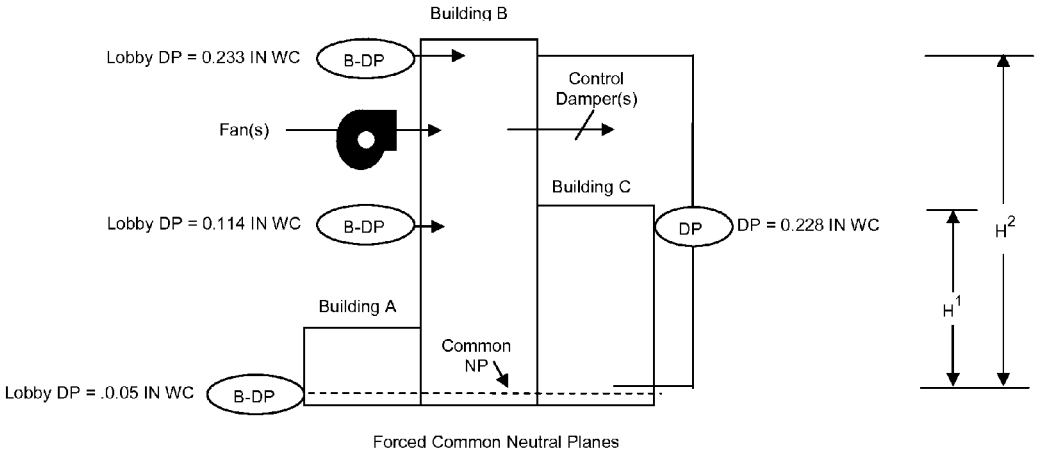
FIG. 12 is an illustration of the application of the present invention to the building complex of FIG. 11, using air handlers and dampers to drive the pressure neutral plan of the complex to the level of the lobby.

For added redundancy, the building pressure control variable can be, and in most cases will be, an average of multiple pressure transmitter readings from various locations and heights in the facility. The reading from each transducer is adjusted by subtracting stack effect pressure differential at the height of the transducer (using the current inside/outside air temperatures, as discussed herein) and the resulting readings are then averaged. Referring to FIG. 11, in a complex scenario, a complex of three buildings of different heights may use differential pressure transducers at three different heights, one located in the lobby of the shortest building A, one at the midpoint of the tallest building B, and one at the top of the tallest building B. The naturally occurring neutral planes will be at the mid height of these three buildings, with all other factors equal, leading to substantial air flows between the buildings; using POBPC, the set point for the air handler fans and dampers is compared to an average of the readings of the differential pressure sensors. Furthermore, that set point is chosen so that the lobby is driven to a differential pressure of −0.05 IN WC, leading to a very slight ingress of air at that level. As seen in FIG. 12, at a low outside air temperature, the resulting differential pressure offset applied to the reading of the pressure sensor at the midpoint of building B at height H1 is 0.114 IN WC and the differential pressure offset applied to the reading of the pressure sensor at the top of building B at height H2 is 0.233 IN WC.

The POBPC control algorithm can be further enhanced by adding an POBPC setpoint reset schedule to the control sequence. This reset schedule is used to automatically drive the building's "neutral plane" lower in the building as appropriate for the current outside air temperature, to manage the lobby's static pressure and prevent excessive air infiltration. Moving the building's "neutral plane" lower than its "natural position" (mechanical systems off) requires fan energy so the reset schedule must be carefully crafted to insure the minimal amount of reset is used to position the neutral plane further down the building height.

The following table shows the reset schedules below for a 100 foot tall seven story building.

TABLE 1

Seven Story Building; 100 Feet in Height

| OSA Temperature | Neutral Plane Height from the Transmitter | Calculated Lobby Pressure |
|---|---|---|
| 25 | 0 Feet | −0.072 |
| 0 | −31 Feet | −0.071 |

Notice that the "neutral position" of the building is not reset until OSA temperature falls below 25 F. At this OSA temperature, the building's lobby static pressure is −0.072 IN WC as compared to OSA conditions. This is slightly negative, but the existing HVAC mechanical systems are usually more than capable of maintaining comfortable lobby conditions at this static negative pressure.

In this example the building's static pressure differential transmitter is placed at the center of the building's height. If this transmitter is located on the upper floor of the building which is a the most remote location from the lobby, in conventional pressure management schemes the lobby in the seven story building would become negative below an OSA temperature of 56 F (not 39 F as above) and a 14 story building's lobby would become negative below an OSA temperature of 74 F (not 56 F as above).

The goal of the above reset schedule above is to keep the lobby pressure of our 100 ft tall building at relatively the same pressure differential to outside air as the weather conditions fall to or below 25 F OSA temperature. As the OSA temperature drops, so does the height of the neutral plane in the building, thus maintaining relatively the same pressure differential between the lobby and outside air at all low ambient OSA conditions.

It should be noted that not all buildings should be configured to reset the neutral plane height at 25 F OSA conditions. The exact temperature would depend on the building's height and mechanical system design factors, the building's height being the most important. A 300 foot tall building may continuously reset its neutral plane, whereas a 50 foot tall building may not need reset its neutral plane at all.

An exemplary reset schedule would be to adjust the pressure setpoint at the desired neutral plane height to zero at temperatures where the building locks out the use of economizer mode (below about 45 degrees or above about 75 degrees outside air temperature). When the economizer mode is used, then the setpoint is increased linearly from a value of 0 at the lowest outside air temperature in which the system uses economizer mode (e.g. 45 degrees), to a value of 0.1 IN ML at the highest outside air temperature in which the system uses economizer mode (e.g. 75 degrees).

Another consideration when developing a neutral plane reset schedule is the building pressure constraints on the uppermost floors. POBPC forces the neutral plane down the building height by pressurizing the upper floors of the building. The system would need to pressurize the upper floor of a 50 story building to almost 2.0 IN WC to drive the neutral plane of the building to its lobby height. These pressures could affect door closures and other architectural aspects of the building (e.g., rooftop access doors may become difficult to close during maintenance procedures) and this effect must be considered when developing a reset schedule. As the building pressure differential to outside air is greatest in the winter, at which time the building pressure at higher floors can much exceed outside air pressure, fire doors to the outdoors should be configured to open outwards so that those doors may be opened notwithstanding building pressurization in the winter. Tall buildings may be best controlled by partitioning into airtight sections, if feasibly done (e.g. during new construction), and/or by the use of vestibules or revolving doors on upper floors that can permit access in the presence of a pressure differential.

Optimal Building Pressure control strategy treats each building in a complex as a separately controlled unit. Each building has its own building's "neutral plane" pressure reset schedule. Each building maintains it own "neutral plane" setpoint by modulating all of its own air handler relief air dampers as a single unit from one PID loop control output. Consider the example in FIG. 10.

Figure 10:
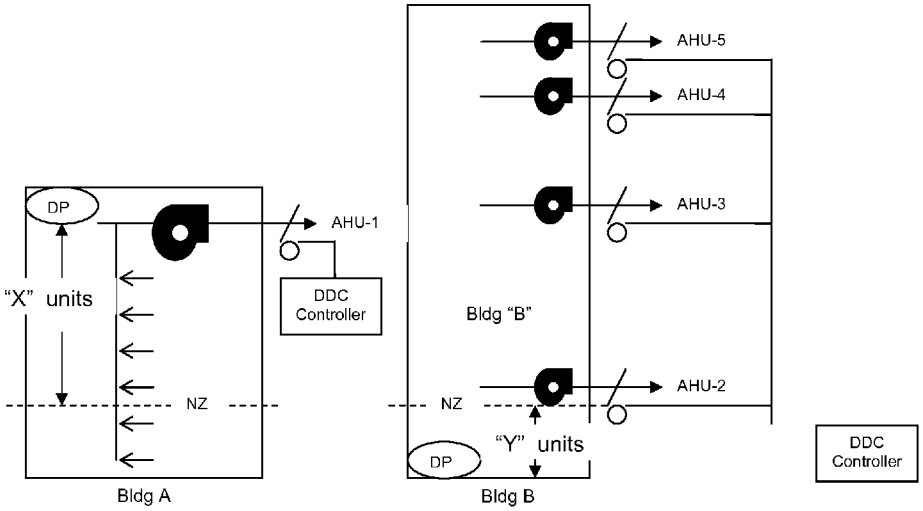
FIG. 10 is an illustration of the application of the principles of the present invention to a building complex having two buildings.

Each building in the FIG. 10 example is sensing the building's differential static pressure as referenced to OSA condition from a single transmitter, or from a group of transmitters whose outputs are offset by known stack effect pressures, and then averaged. The location of the transmitter(s) is not important as long the height of its location in the structure is known. Building "A" in the FIG. 10 example is being controlled "X" units below the transmitter, building "B" is being controlled "Y" above the transmitter and each building is automatically controlling their respective neutral planes at the exact same building height as referenced to ground level.

Another important attribute of the POBPC approach is maintaining the neutral plane position regardless of season of year. Whether the lower portion of the building is naturally under a negative pressure as in winter or a positive pressure as in the summer, the control algorithm will automatically adjust to maintain whatever neutral plane height is desired, typically chosen to maximize air temperature regulation by minimizing negative pressure and air ingress in sensitive locations.

When designing an POBPC control strategy for a large facility, a designer needs to consider connection points between buildings and how these connection points may transfer air as stack effect pressure differentials form between buildings. This needs to be considered for both summer and winter conditions. Every connecting hallway between buildings will transfer air if there is a difference in pressure between the two buildings' connected floors.

As a first step, a designer should create a simple schematic drawing of the facility. This should depict each building and each connecting hallway in the facility. Then the designer should determine where the "neutral plane" should be positioned for each building to minimize air flow between the two structures. A hierarchy needs to be followed when selecting the neutral plane for each building. First the most critical floor's building pressure should be determined, then the most critical building pressure for the facility. This would normally be the main entrance lobby on a lower floor of a building.

Selecting a building's neutral plane may be complex. A single building may have multiple connecting buildings of different heights and arrays of connecting hallways between all buildings. In this case, a designer would need to choose a "neutral plane" setpoint for each building that would minimize airflows between all connecting hallways. Revolving doors or other isolating doors may be used in some hallways where a pressure differential cannot be easily avoided consistent with other design constraints.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A method of controlling the air flow of an HVAC system for a multi-story building having a lobby level with an occupant entrance and one or more additional levels above and/or below the lobby level, the HVAC system including a heating and air conditioning system for supplying conditioned air to the building, and a return air path for removing air from the building, the return air path including a recirculate output for delivering return air to the conditioning system, and a relief output for exhausting return air to the atmosphere surrounding the building, the method comprising:

a. measuring a pressure differential between the building air and atmosphere air at a sensor location, b. computing a desired pressure differential between the building air and atmosphere air at the sensor location, based upon a height difference between the sensor location and the lobby level, and a computed stack effect pressure that is expected to develop at the sensor location on the building when a desired pressure difference is present at the lobby level for a current inside and outside air temperature in the absence of mechanical action, and c. controlling the return air path to pressurize the air in the sensor location to produce the desired pressure differential between the building air and atmosphere air at the sensor location.

2. The method of claim 1 wherein controlling the return air path comprises controlling a speed of a return fan in the return air path to create a pressure differential between air in the return air path at the exhaust of the fan and outside air pressure, that is slightly greater than the desired pressure differential.

3. The method of claim 1 wherein controlling the return air path comprises controlling a damper in the relief air output to control the pressure differential between the building air and atmospheric air to the desired pressure differential.

4. The method of claim 1 wherein the desired pressure differential is computed based upon the building configuration.

5. The method of claim 1 wherein the desired pressure differential is computed with the formula $$p_c = 7.6\ h\left(\frac{1}{t_c + 460} - \frac{1}{t_i + 460}\right).$$

where pc is the desired pressure differential in inches of water column, h is the distance in feet from the height of the pressure sensor to the height of a desired neutral pressure in the building, and tc and ti are outside and inside temperatures in ° F.

6. The method of claim 5 wherein the desired pressure differential is computed using the height of the building lobby as the desired neutral pressure location.

7. The method of claim 1 wherein the pressure differential between outside air and building air is measured at a plurality of sensors.

8. The method of claim 7 wherein a desired pressure differential between the building air and atmosphere air is computed for each of the plurality of sensors, based upon a computed stack effect pressure that is expected to develop at each sensor's location on the building for the current inside and outside air temperature in the absence of mechanical action.

9. The method of claim 8 wherein the return air path is controlled to pressurize the air in the building in response to a combined measure of the relationship of the building air pressure at the plurality of sensor locations and the desired pressure differential between the building air and atmosphere air at each of the plurality of sensor locations.

* * * * *

UNITED STATES PATENT AND TRADEMARK OFFICE

CERTIFICATE OF CORRECTION

PATENT NO. : 9,494,335 B1
APPLICATION NO. : 13/890940
DATED : November 15, 2016
INVENTOR(S) : Daniel Buchanan It is certified that error appears in the above-identified patent and that said Letters Patent is hereby corrected as shown below:

On the Title Page

Column 2, in the (57) Abstract Line 3, delete:
"... return air plenum PL-1 used for removing or recirculate air ..."
Insert:
--...return air plenum PL-1 used for removing or recirculating air--.

Column 2, in the (57) Abstract Line 12, delete:
"... pressurize the air in at the sensor location to produce the ..."
Insert:
--... pressurize the air in the sensor location to produce the ...--.

In the Specification

Column 1, Line 13, delete:
"... tems. Air handlers input output and return fans, and may ..."
Insert:
--... tems. Air handlers include input, output, and return fans, and may ...--.

Column 2, Line 24, delete:
"... difference in temperature between the inside and inside and..."
Insert:
--...difference in temperature between the inside and ...--.

Column 7, Line 2, delete:
"... quantities of air migrate to the upper floors of the building."
Insert:
--... quantities of air to migrate to the upper floors of the building.--.

Signed and Sealed this
Twelfth Day of April, 2022

Drew Hirshfeld
*Performing the Functions and Duties of the*
*Under Secretary of Commerce for Intellectual Property and*
*Director of the United States Patent and Trademark Office*

Column 8, Line 3, delete:
"... related forces, the taller structures upper floor pressure ..."
Insert:
--...related forces, the taller structure's upper floor pressure ...--.

Column 8, Line 5, delete:
"...Upper Floor Pressure=lobby DP+the taller buildings ..."
Insert:
--...Upper Floor Pressure=lobbyDP+the taller building's ...--.

Column 8, Line 27, delete:
"... time including an exhaust fan to the top of building on the ..."
Insert:
--...time including an exhaust fan to the top of the building on the ...--.

Column 8, Line 57, delete:
"... desired position of a structures "neutral plane" pressure, and ..."
Insert:
--...desired position of a structure's "neutral plane" pressure, and ...--.

Column 8, Line 60-61, delete:
"As stack effect pressure differential increase on a structure, the ..."
Insert:
--As stack effect pressure differential increases on a structure, the ...--.

Column 10, Line 26, delete:
"... air handlers fan tracking and building pressurization ..."
Insert:
--... air handlers, fan tracking, and building pressurization ...--.

Column 10, Line 50, delete:
"... dampers to maintain the buildings static differential setpoint."
Insert:
--... dampers to maintain the building's static differential setpoint.--.

Column 10, Lines 52-53, delete:
"... relief dampers, the units return air fans speeds are automatically adjust to ..."
Insert:
--... relief dampers, the unit's return air fans' speeds are automatically adjusted to ...--.

Column 11, Line 10, delete:
"... each respective buildings differential pressure sensing ..."
Insert:
--... each respective building's differential pressure sensing ...--.

Column 12, Line 62, delete:
"...which is a the most remote location from the lobby, in..."
Insert:
--... which is the most remote location from the lobby, in...--.

Column 13, Line 1, delete:
"The goal of the above reset schedule above is to keep the ..."
Insert:
--The goal of the reset schedule above is to keep the ...--.

In the Claims

Column 16, Line 1, Claim 5, Line 3, delete:
"... where pc is the desired pressure ..."
Insert:
--... where $p_c$ is the desired pressure ...--.

Column 16, Line 4, Claim 5, Line 6, delete:
"...the building, and tc and ti are outside..."
Insert:
--... the building, and $t_c$ and $t_i$ are outside...--.